United States Patent [19]

Rey

[11] Patent Number: 5,069,158

[45] Date of Patent: Dec. 3, 1991

[54] HYDROSTATIC BEARING SUPPORT OF STRIP

[75] Inventor: Giorgio A. Rey, Wexford, Pa.

[73] Assignee: Italimpianti of America, Inc., Coraopolis, Pa.

[21] Appl. No.: 606,538

[22] Filed: Oct. 31, 1990

Related U.S. Application Data

[62] Division of Ser. No. 499,796, Mar. 27, 1990, Pat. No. 5,015,509.

[51] Int. Cl.[5] ..... B05C 3/15

[52] U.S. Cl. ..... 118/410; 118/419; 118/423; 118/428

[58] Field of Search ..... 118/68, 419, 423, 428, 118/410

[56] References Cited

U.S. PATENT DOCUMENTS

| | | | |
|---|---|---|---|
| 2,060,430 | 11/1936 | Spooner | 118/68 |
| 2,159,297 | 5/1939 | Shover | 118/419 X |
| 2,418,386 | 4/1947 | Wood | 134/99 |
| 2,702,525 | 2/1955 | Whitfield | 118/423 X |
| 3,097,971 | 7/1963 | Carlisle et al. | 134/15 |
| 3,191,835 | 6/1965 | Fenn | 226/97 |
| 3,230,752 | 1/1966 | Dobson et al. | 72/202 |
| 3,479,097 | 11/1969 | McLaughlan et al. | 384/12 |
| 4,178,397 | 12/1979 | Lovis | 118/406 X |
| 4,418,100 | 11/1983 | Bedwell et al. | 427/348 |
| 4,448,460 | 5/1984 | Yamamoto | 384/12 |
| 4,481,235 | 11/1984 | Foell et al. | 118/423 X |
| 4,500,561 | 2/1985 | Kim et al. | 427/25 |
| 4,513,033 | 4/1985 | Patil et al. | 427/349 |
| 4,634,609 | 1/1987 | Fabiny et al. | 427/345 |
| 4,752,508 | 6/1988 | Sippola | 427/433 |

*Primary Examiner*—Michael Wityshyn

*Attorney, Agent, or Firm*—Webb, Burden, Ziesenheim & Webb

[57] ABSTRACT

A frictionless strip support for supporting a metallic strip conveyed along a feed path in a treatment process. The support including at least one hydrostatic chute including a plurality of confined hydrostatic chambers having apertures therein for a supply of a pressurized treatment liquid such as molten metal, and at least one pair of hydrostatic guides positioned downstream of the hydrostatic chute. Each hydrostatic guide has a confined hydrostatic chamber with apertures therein for supply of a pressurized treatment liquid such as liquid metal. The frictionless support also includes a pump of supplying the pressurized treatment liquid through the apertures and to the confined chambers such that the treatment fluid maintains the strip spaced from the hydrostatic chute and the hydrostatic guides by hydrostatic force of the pressurized liquid normal to the strip surface as the strip is conveyed across the hydrostatic chute and the hydrostatic guides. In metal coating processes, such as zinc coating, the hydrostatic guides are placed at the surface of the zinc bath to create an upwardly flow of dross-free molten zinc on both sides of the exiting strip material whereby surface quality is improved independent of strip speed.

10 Claims, 4 Drawing Sheets

HYDROSTATIC BEARING SUPPORT OF STRIP

This is a divisional of copending application Ser. No. 07/499,796 filed on Mar. 27, 1990 now U.S. Pat. No. 5,015,509.

FIELD OF THE INVENTION

The present invention relates to a method and apparatus for substantially frictionless strip support and, more particularly, to a method and apparatus for supporting and treating a strip by hydrostatic bearing means wherein the supporting fluid is also preferably the strip treating medium.

DESCRIPTION OF THE PRIOR ART

A metallic strip such as steel strip is typically treated in a metallurgical process, such as chemical treatment, hot dip zinc galvanizing and the like, by conveying the strip into a reservoir or bath of a treatment fluid such as liquid metal and keeping the strip immersed therein for a sufficient time until the treatment fluid has affected the surfaces of the strip. After a prescribed time, the treated strip is removed from the reservoir for additional and complementary finishing operations and treatments. A strip may be conveyed through the reservoir by various known supporting and conveying devices useful in such metallurgical treatments.

Typical apparatus for treating a metal strip in a liquid bath usually employ one or more sink rolls which maintain the strip in a submerged mode while redirecting the strip travel from the inlet to outlet directions relative to the bath. Typical of such arrangements are the hot dip zinc coating apparatus disclosed in U.S. Pat. Nos. 4,418,100; 4,500,561; 4,513,033; and 4,752,508.

U.S. Pat. No. 3,097,971 to Carlisle et al. discloses another method and apparatus for supporting and guiding flat metallic materials, such as steel strip and plate. Carlisle et al. suggests the use of a plurality of fixed support members having curved surfaces with a plurality of holes or slots formed therein for the emission of an unrestrained pressurized fluid for supporting a strip in a spaced relation from the curved surfaces. In operation, a strip of material is guided along a serpentine path formed by spaced apart support members located at each bend position. Each support member includes a convexly shaped support surface perforated with a number of holes through which a fluid, such as air, is forced towards the strip. The pressurized fluid is said to be trapped between the support surface and the strip for a sufficient time to form a cushion on which the strip floats while being pulled through the apparatus by draw rolls.

It is apparent that the Carlisle device would require extremely high fluid pressures during start-up, at the time when the strip is in direct contact with the support members. Due to the unconfined flow of the fluid in the Carlisle et al. device, it is questionable whether lifting would occur and, even then, the fluid pressure would not be under control.

U.S. Pat. No. 4,634,609 to Fabiny et al. discloses a method and apparatus for coating metal sheets with a molten material. The material is passed through a coating chamber having a bath of material whereupon the fluid coating material overflows in the chamber to prevent surface contamination of the coating due to dross and the like. The coating chamber contains raised, longitudinally extending guide means within its interior to reduce contact between the surfaces of the metal sheet and the spaced-apart surfaces of the coating chamber. The guide means comprise a plurality of laterally spaced-apart, raised ridges with open ends that follow the curvature of the walls. Fabiny et al. teaches that without the guides there is a possibility that the sheet could press up against the orifices of the inlet manifolds and partially block the flow of molten coating material therethrough. Since the guide means of Fabiny et al. have open end regions, the fluid pressure will not be constant and will be particularly low at the ends which is critical if true hydrostatic support is to be achieved.

SUMMARY OF THE INVENTION

I have invented a new substantially frictionless strip support which broadly comprises a number of curved deflector chutes having a plurality of confined closed hydrostatic chambers formed thereon. Pressurized fluid is emitted through apertures in the surface of the curved chutes an confined within the restricted hydrostatic chambers to form a hydrostatic support for a strip material being passed over the surface thereof. The curved chutes of the present invention ideally replace conventional strip deflector or sink rolls employed in various metallurgical treatment lines such as, for example, in chemical treatment or strip metal coating lines. It will be appreciated that the use of a hydrostatic support fluid which is the same as the treatment fluid used in chemical treatments or in hot metal coating reduces the physical size of the treatment tank, assuming equal values of residence times in various metallurgical treatment processes. Reduced capital and process costs are obvious benefits of the present invention.

It is understood that although, for purposes of clarity, the present invention is described in connection with the treatment of a metallic strip material, the present invention may be equally applicable to any linear material, such as wire, pipe, bar and the like. Materials such as plastic, ceramics, and the like, are also suitable in addition to the described metal material.

It is an object of the present invention to provide a substantially frictionless strip support for use in a variety of chemical and/or metallurgical treatment processes. Another object of the present invention is to provide a substantially frictionless strip support using hydrostatic pressure exerted by a treatment fluid acting on the strip. It is a further object of the present invention to provide a method and apparatus for metallurgically coating a strip to yield a dross-free surface. Yet another object of the present invention is to provide a frictionless strip support that permits a hot dip zinc treatment line for a strip to be run at varying speeds without adversely affecting the surface quality thereof. Another object of the present invention is to provide a process and apparatus wherein a metallic sheet is coated by passing it through a molten bath in such a way that the occurrence of defects on the surface of the metal sheet is reduced or eliminated.

When applied to hot dip zinc coating of steel strip, the present invention provides a method and apparatus which greatly reduces the capital equipment costs and plant space requirements heretofore required in such process lines. The present invention further provides minimum exposure of molten metal to atmospheric air whereby coating metal quality is greatly enhanced and energy costs are concurrently reduced.

Briefly stated, my invention is directed to a substantially frictionless strip support for supporting a metallic strip conveyed along a feed path in a treatment process. The support comprises at least one hydrostatic chute including a plurality of hydrostatic chambers, each having an aperture therein for supply of a pressurized fluid such as liquid metal and preferably at least one pair of opposed hydrostatic guides positioned downstream of the hydrostatic chute. Each hydrostatic guide includes a plurality of hydrostatic chambers, each having an aperture therein for supply of a pressurized fluid. The frictionless support of the invention also includes a hot metal pump for supplying the pressurized liquid metal to the apertures within the hydrostatic chambers. Each of the fluid apertures are bounded by raised borders defining the hydrostatic chamber areas which confine the pressurized liquid and form localized, but continuous, hydrostatic cushioning zones along the chute and guides. After entry into the hydrostatic chamber, the liquid metal is restrained within the confines of each chamber and, thus, maintains the strip spaced from the hydrostatic chute and the hydrostatic guides by hydrostatic force of the pressurized fluid normal to the strip surface as the strip is conveyed thereacross. Drain troughs extend laterally across the chute between adjoining confined chamber areas to permit continuous flow of molten metal or other liquid therein for drainage at the strip edges. The present invention also includes conventional wiping devices for removing excess liquid metal from the strip as it exits the hydrostatic guides.

In the case of hot dip zinc coating, the exit hydrostatic guides are positioned at the molten metal surface and produce an upwardly directed flow of dross-free liquid zinc metal which keeps the metal dross from coating the strip by providing a dross-free zone on both sides of the coated metal strip as it exits the bath. Strip surface quality is greatly improved and is not dependent upon critical line speed control as in the prior art.

In one presently preferred embodiment useful for metal coating, the substantially frictionless strip support includes a hydrostatic chute and a pair of opposed hydrostatic guides completely enclosed within a confined molten metal containing compartment of a "J"-shape which receives preheated metal strip directly from a furnace without the need for a molten metal bath. The present invention may also include a pair of collection troughs positioned adjacent the hydrostatic guides to collect excess fluid metal wiped therefrom for return to an enclosed molten metal holding vessel and eventual recirculation to the hydrostatic chute and hydrostatic guides.

BRIEF DESCRIPTION OF THE DRAWINGS

Further features and other objects and advantages of the invention will become clear from the following detailed description when taken with the drawings in which.

DESCRIPTION OF THE PREFERRED EMBODIMENTS

Figure 1:
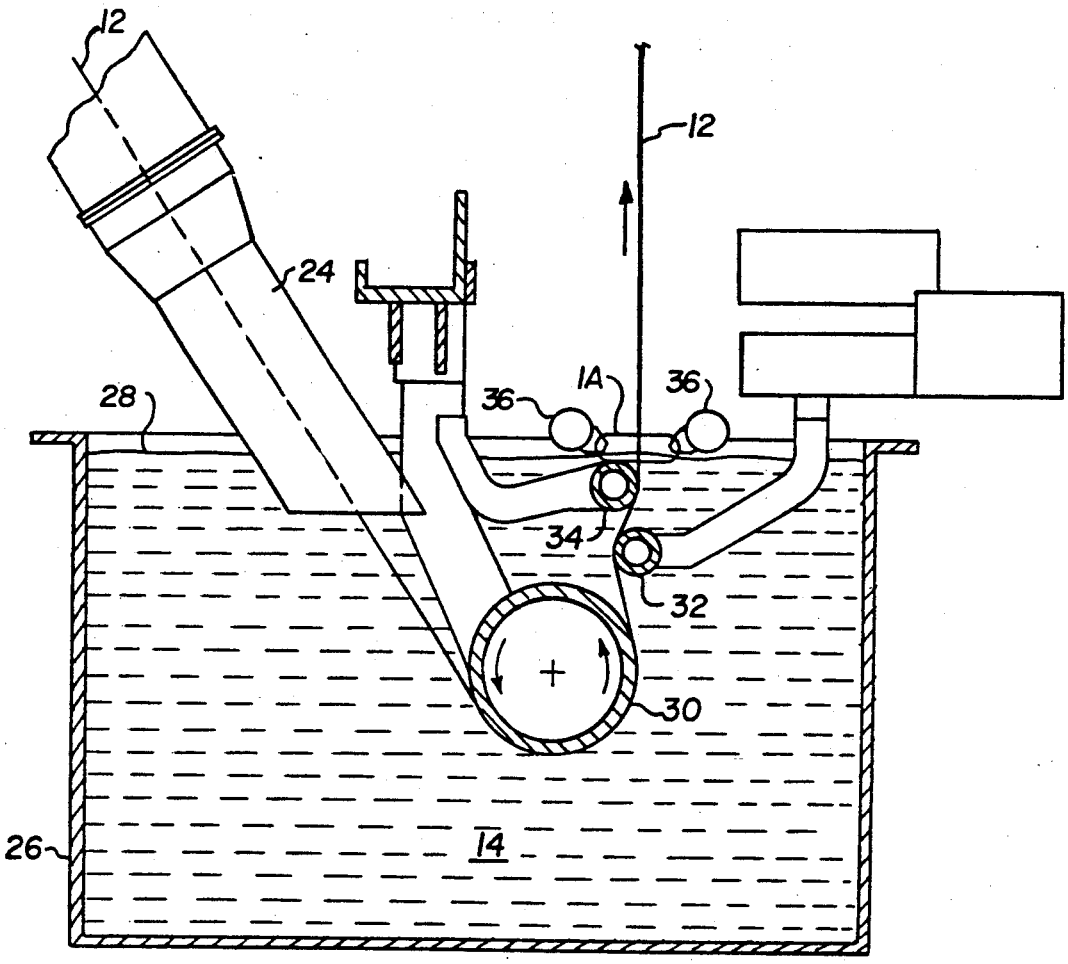
FIG. 1 PRIOR ART
FIG. 1 is a cross-sectional side view of a conventional prior art strip support used in a metal treatment process.
Figure 1A:
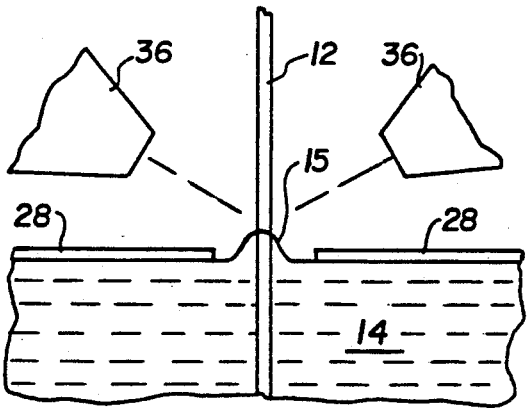
FIG. 1A PRIOR ART
FIG. 1A is an enlarged fragmented view of the strip exit area "1A" of FIG. 1.

Referring to the drawings, wherein like reference characters represent like elements, FIGS. 2—7 show strip support apparatus of the present invention generally designated 10 for use in a metallurgical treatment process, and wherein FIGS. 1 and 1A relate to the prior art.

A typical prior art treatment system for applying a hot dip zinc coating to a steel strip as shown in FIGS. 1 and 1A includes a furnace snork 24 immersed in a liquid metal bath 14 held within a containment reservoir or pot 26. The submerged end of the furnace snork 24 seals the preheated strip 12 from the normal surrounding atmosphere and also prevents contact with the dross layer 28 floating on the surface of the molten metal bath. The system also includes a sink roll 30, a front stabilizer roll 32 and a rear stabilizer roll 34 to reduce strip vibration and to reduce strip crossbow resulting from the bending of the strip caused by the sink roll 30. The pot 26 holds the fluid molten metal 14 which is heated through various known heating systems such as induction, gas burners, and electric resistance and the like. Air or inert gas knives 36 are provided above the pot to control the thickness of the metal coating as the strip 12 is drawn from the pot 26. In an effort to prevent the dross 28 from contaminating the coated strip 12 as it exits the molten bath 14, it is common practice in the art to pull the strip at a sufficiently high speed, between about 100 to 500 feet per minute, to create a pumping effect at the surface of the bath. This strip induced pumping action creates a raised metal zone 15 which is free of dross, FIG. 1A. In order to insure consistent surface quality, however, line speed must be closely controlled, which has caused problems in the past.

With reference to FIGS. 2-5, a strip material 12 is hydrostatically supported as the strip is concurrently treated by conveying the strip material through a reservoir of the supporting fluid such as a molten metal 14, for example, molten zinc or aluminum, using a substantially frictionless strip support apparatus 10 of the present invention. Although the invention is described in reference to a protective metal coating treatment for a ferrous strip material, such as steel strip or the like, the present invention is equally applicable to other materials and other treatment processes such as chemical pickling of metal strip using known liquid pickling solutions or liquors and the like, as the supporting and treating liquid. Other strip materials, such as plastic, ceramic or the like, are also applicable.

The strip support 10 produced in accordance with the present invention includes at least one hydrostatic chute 16 having a plurality of hydrostatic chambers 20 formed thereon and piping means 19 for introducing a supply of pressurized fluid through calibrated orifices 17 and apertures 18 positioned within each of the hydrostatic chambers 20 to maintain the strip 12 spaced from and out of contact with the hydrostatic chute. The hydrostatic chute 16 may either be curved convex, concave or planar. The apertures 18 are positioned such that a flow of pressurized fluid 14 is flowably confined within hydrostatic chambers 20 and the surface of the strip 12 which produces hydrostatic pressure. The hydrostatic chambers 20 are open-faced and formed on the strip facing side of the chute 16 within the square or rectangular areas defined by raised ridges or borders 21 which extend outwardly from the chute 16. The fluid 14 is forced by a pumping action into the confined hydrostatic chambers 20 to develop a uniform hydrostatic pressure between the adjacent surface of the strip 12 and surface of the hydrostatic chute 16 as the confined fluid 14 flows between strip 12 and ridges 21. The pressurized fluid 14 continuously flows to the ridged borders 21 along the lateral edges of the strip to recycle within pot 26. The hydrostatic chutes 16 are also provided with transversely extending drain slots 22 formed between confronting borders 21 of adjacent hydrostatic chambers 20.

The hydrostatic pressure created by the exiting fluid 14 contained within each hydrostatic chamber 2 forces the strip 12 away from the hydrostatic chute 16 creating a cushioning effect between the strip and the chute. It will be appreciated that under the principles of hydrostatics, if a tensile force is applied to the strip causing the strip to deflect towards the hydrostatic chute surface, the area between the strip and the chute 16 becomes more constricted and a resulting pressure increase occurs on the side of the strip towards the hydrostatic chute thereby forcing the strip away from the hydrostatic chute to an equilibrium position. Moreover, as the strip is caused to depart further from the hydrostatic chute surface, the pressure therebetween decreases until an equilibrium position is obtained. Thus, the strip in the present invention utilizing the principles of hydrostatics is forced to maintain an equilibrium position away from the hydrostatic chute as it is conveyed therealong.

It will also be appreciated that the hydrostatic chute 16 of the present invention replaces the conventional sink roll 30 currently employed in various metallurgical treatment processes such as, for example, in chemical pickling or hot dip zinc galvanizing. The radius of the curved hydrostatic chute 16 can be made 50% larger than the radius of the sink roll 30 with less space requirements than previously required. Also, due to the larger bending radius provided by chute 16, the strip 12 receives far less of the so-called crossbow effect due to residual stresses, thus eliminating the need for prior straightening rolls 32, 34 of FIG. 1. Moreover, the present invention reduces differential tensions, or strip tension losses. A further advantage of the present invention is that the use of a treatment fluid as a support fluid reduces the physical size of the treatment tank and/or residence time for treatment of the strip. This is due to the fact that the hydrostatic support fluid also acts as the treatment media.

Figure 2:
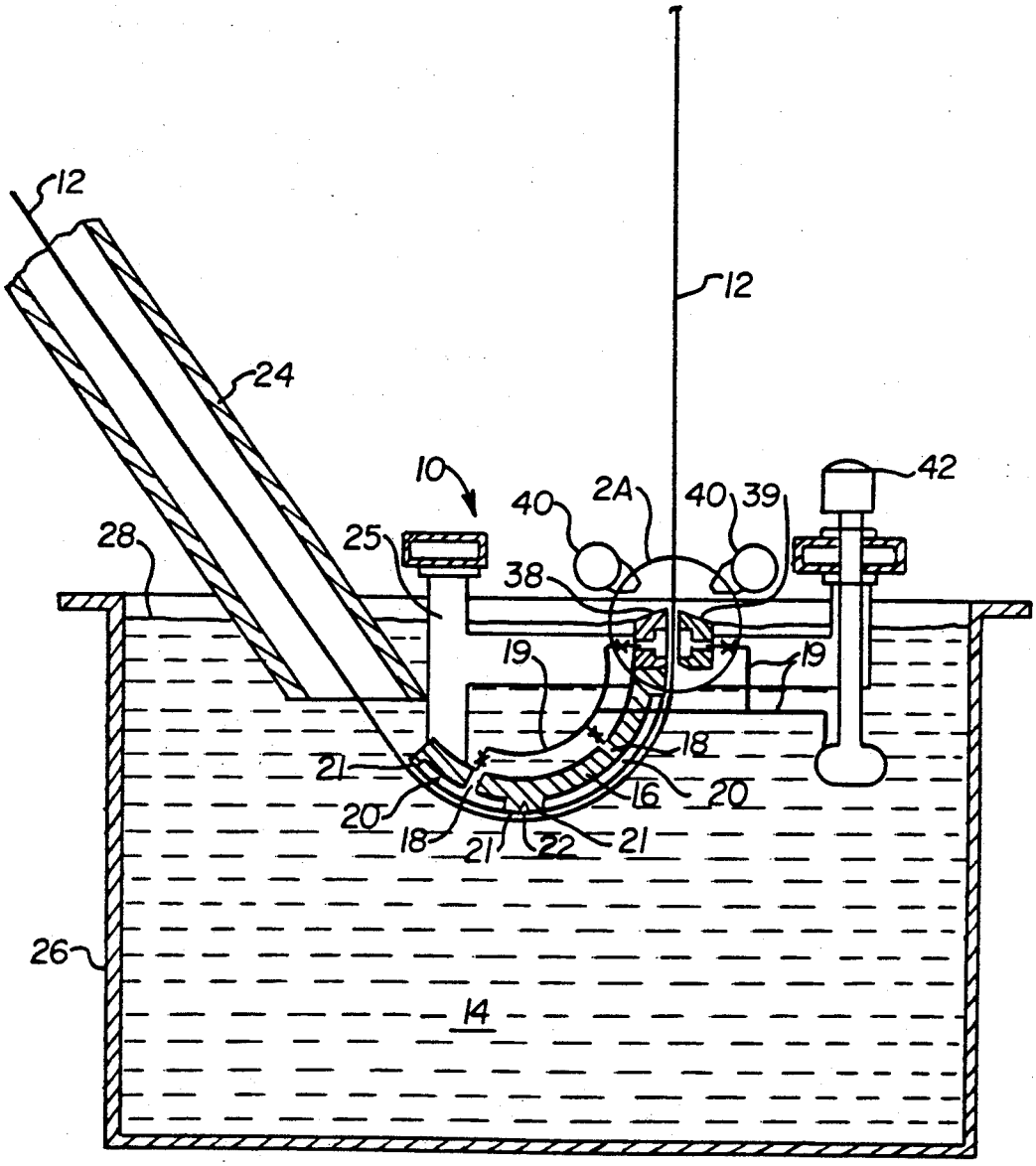
FIG. 2 is a cross-sectional side view of a strip support apparatus of the present invention used in a metal treatment process.
Figure 3:
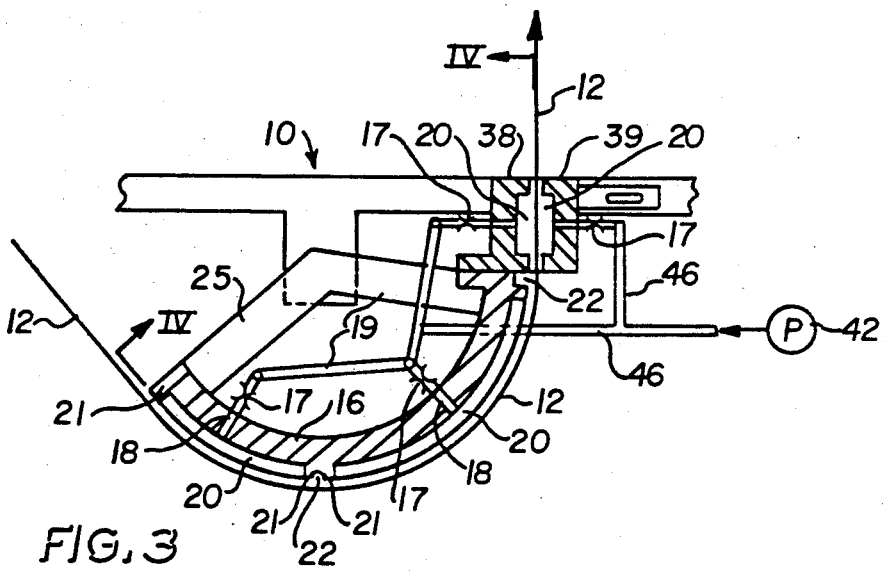
FIG. 3 is a partially enlarged fragmented, cross-sectional side view of the strip support apparatus of FIG. 2.

With specific reference to FIGS. 2-3, the substantially frictionless strip support apparatus 10, in accordance with the present invention, is shown, which is suitable for metal coating operations. The support apparatus includes a furnace snork 24, a pot 26 containing a fluid metal 14, such as molten zinc or aluminum or the like, a hydrostatic chute 16 and hydrostatic guides 38 and 39. The strip support 10 further includes a pair of gas-wiping devices 40 for removing excess fluid metal coating from the coated strip as it exits the pot 26. A pump 42 provides a fluid, such as liquid metal, to the apertures 18 of the hydrostatic chute 16 submerged within the pot 26 and, in turn, to the hydrostatic guides 38 and 39 positioned at the interface of the liquid metal 14 and ambient air. Liquid metal 14 is pumped through conduits 19 which extend from the pump 42 to the apertures 18. A structural frame 25 supports the apparatus 10 and molten metal pump 42 within the pot 26.

Figure 6:
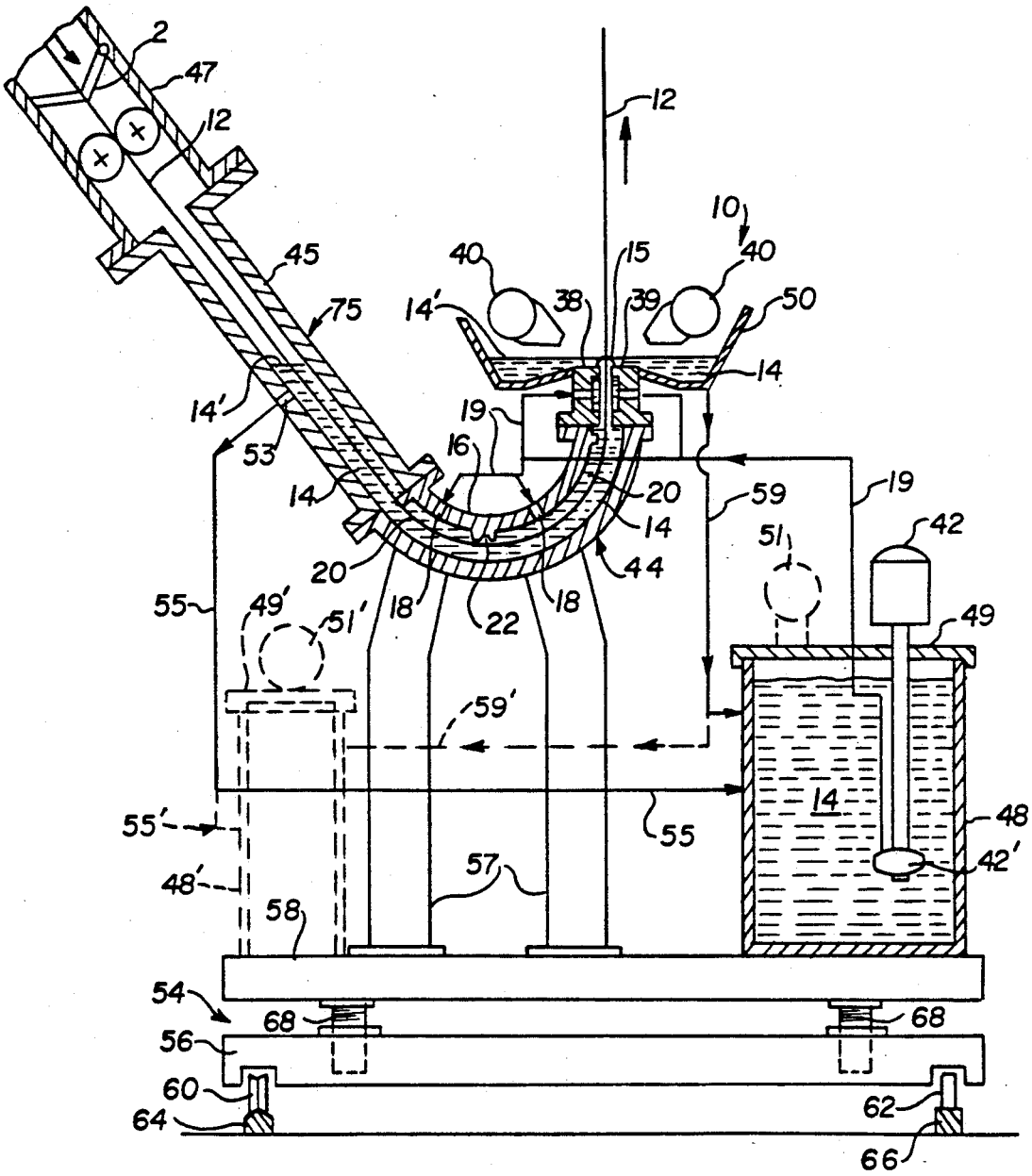
FIG. 6 is a cross-sectional side view of a further embodiment of the strip support of the invention on a rail-mounted stand.

The strip 12 is initially fed from a conventional annealing furnace (not shown) with controlled atmosphere through a snork 24. The strip 12 travels in a direction indicated by arrows through the furnace snork 24 and into a pot 26 containing the liquid metal 14 such as molten zinc. As shown in FIGS. 2, 3 and 6, the strip 12 glidingly travels around a hydrostatic chute 16 having an arcuate shape. As stated above, the hydrostatic chute 16 of FIG. 2 is submerged in the liquid metal 14 and can be designed with a radius substantially larger than the sink roll 30 of the prior art without enlarging the size of the pot 26. This larger radius reduces strip crossbow due to residual stresses and thus reduces the need for the prior art stabilizer rolls 32 and 34 of FIG. 1. The strip 12 is conveyed from the hydrostatic chute 16 upwardly through a pair of hydrostatic guides 38 and 39 and exits from the liquid metal 14 between the hydrostatic guides along an approximately vertical path.

Figure 2A:
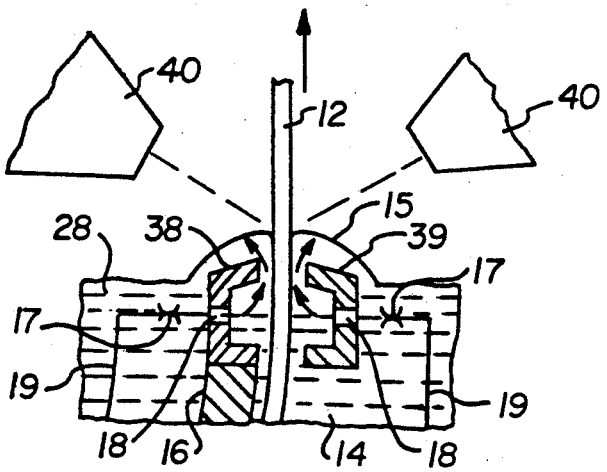
FIG. 2A is an enlarged fragmented view of the strip exit area "2A" of FIG. 2.

As seen in FIG. 2A, the hydrostatic guides 38 and 39 surround the strip 12 with free dross metal so there is no contact between the exiting coated strip and harmful dross 28 which may be floating on the top surface of the liquid metal bath 14. The hydrostatic guides 38 and 39 create an artificially induced strip pumping effect to provide a continuous dross-free raised zone 15 on the bath surface as in the prior art, but one which is not dependent upon strip speed, as required in the prior art. Thus, my invention provides a dross-free coated strip without the need for running the strip at critical speeds as previously required to achieve the necessary dross-free zone 15. A wide range of strip speeds of from 10-900 feet per minute, for example, is suitable in conjunction with the present invention. The hydrostatic guides 38 and 39 include spaced-apart hydrostatic chambers 20 and orifices 17 having apertures 18, and conduits 19 positioned on each side of the strip 12 adjacent the liquid metal surface. From the hydrostatic guides 38 and 39, the strip 12 passes between a pair of wiping devices 40 to remove excess liquid metal and provide a uniform coating thereon. As shown, the wiping devices 40 comprise a pair of conventional gas knives 36 which discharge pressurized gas against opposite sides of the moving strip 12 to remove excess coating material from the strip thereby leaving a desired coating thickness and distribution of liquid metal. It will be appreciated that a wide range of coating thicknesses and distributions may be established on the strip by controlling the pressure profiles of the gas discharged from the gas knives 36. The improved flat cross-section of the strip produced on the larger radiused guide chute of the invention, permits improved coating thickness control by the wiping devices 40 so as to provide greater uniformity in coating thickness. Of course, an inert or reducing gas may be used to wipe the surface of the coated strip to prevent surface oxidation.

Figure 4:
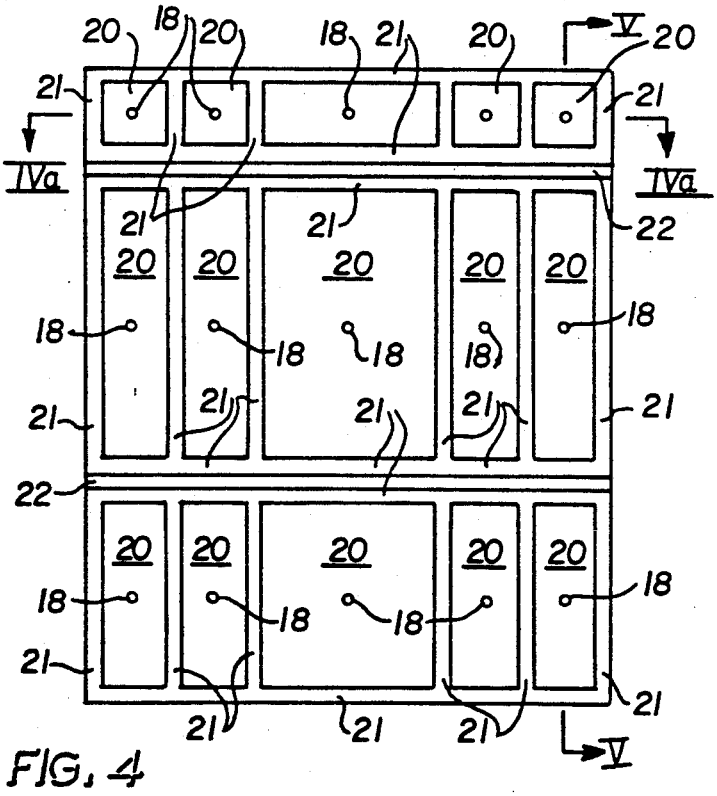
FIG. 4 is an enlarged, developed or linear plan view of the strip support apparatus taken about line IV—IV of FIG. 3.
Figure 5:
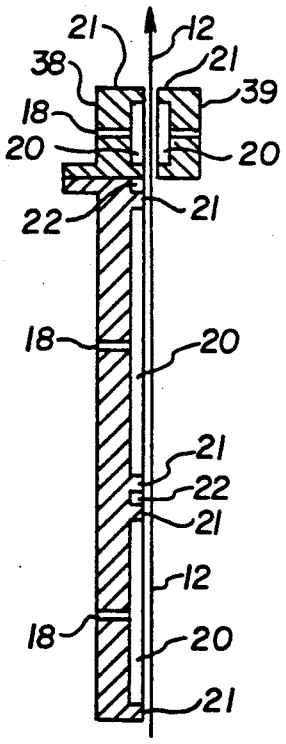
FIG. 5 is an enlarged cross-sectional side view of the frictionless strip support taken along line V—V of FIG. 4.
Figure 4A:
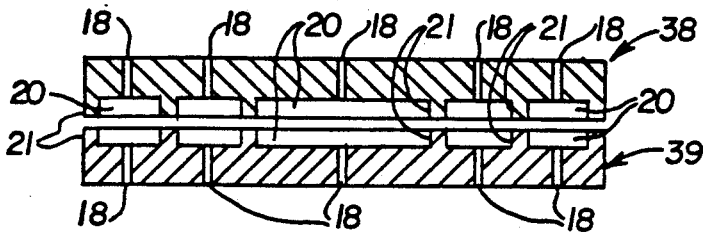
FIG. 4A is a cross-sectional end view taken along line IVa—IVa of FIG. 4.

The hydrostatic chute 16 shown in FIGS. 3-5 carries a plurality of confined hydrostatic chambers 20 along the longitudinal length and transverse width of the chute. Each chamber 20 has a centrally located, outwardly directed aperture 18 and is in communication with a pumping means 42 by way of conduits !9 and calibrated orifices 17 to supply molten metal 14 thereto. Calibrated orifices 17 are preferably placed in conduits 19 to regulate the flow characteristics of the molten metal 14 or other liquid through the apertures 18. A hydrostatic pressure is created by the flow of liquid media 14 from the apertures 18 and confinement within each of the chambers 20 which acts against the strip 12 causing the strip to be forced outwardly from the hydrostatic chute 16 while concurrently insuring complete chemical treatment or metal coating of the strip. Molten metal or other liquid support media is flowably confined within the hydrostatic chambers 20 and continuously flows over the raised, ridged borders 21 thereof transversely toward the strip edges and longitudinally beneath the strip to drain through the slots 22 which extend transversely relative to the strip edges. It will be appreciated that the number and size of the chambers 20 within the hydrostatic chute 16 and guides 38 and 39 required to support a strip 12 is a function of the strip width, the pump capacity and the viscosity of the liquid support media 14 flowing through the apertures. The transverse array of hydrostatic chambers 20 shown in FIG. 4, comprising a large central chamber area with two chambers of narrower width on either side thereof, is capable of supporting strip materials of varying widths. In the case where a narrower strip width is being run, the outermost chamber apertures 18 not covered by the strip may be selectively shut-off, for example.

The hydrostatic guides 38 and 39 also include chambers 20 formed within each guide having a plurality of apertures 18 connected through a conduit 19 to a pump 42 for pumping liquid metal 14 thereto. The gap between the guides 38 and 39 is adjustable to provide flexibility in positioning of the strip 12 and prevent dross layer 28 from contacting the strip !2. The guides 38 and 39 may be designed to maintain a straight cross profile of the strip or to provide a curve across the profile of the strip.

FIG. 6 illustrates a presently preferred embodiment of the present invention which eliminates the conventional open immersion pot 26. The hydrostatic chute 16 and guides 38 and 39 form an enclosed fluid-tight compartment 44 for containing the molten metal or other treatment fluid, which greatly reduces space requirements, capital and operating costs over prior open pot systems. The hydrostatic chute 16 and guides 38 and 39 are of a form and of a function substantially identical to that previously described. The fluid-tight compartment 44 has an elongated section 45 which extends from a furnace 47 to provide a generally "J"-shaped closure 75 for containing the strip 12 and molten metal 14. The molten metal assumes a level 14' within the closure 75 and in overflow troughs 50. A gate valve 2 in furnace 47 provides sealing of the furnace gases during chute changeover operations. A mini pot 48, spaced apart from the hydrostatic chute 16 and the hydrostatic guides 38 and 39, contains liquid metal 14 which is recirculated to the fluid-tight compartment 44 by a hot metal pump 42. The pump 42 has a suction side 42' that draws in the liquid metal 14 within the mini pot 48 and forces it, under pressure, through the conduits 19 to apertures 18 and hydrostatic chambers 20 so that the liquid metal is forced against the facing surface of the strip 12. The mini pot system of this embodiment may be of any suitable size and either exposed or covered by a lid 49 to reduce oxidation of the liquid metal 14. The enclosed system naturally provides a cleaner melt having reduced dross problems, especially if the atmosphere in the pot is made non-oxidizing.

When using the gas-tight lid 49, the pot 48 can also be pressurized by a non-oxidizing or inert gas, such as nitrogen or argon, for example. A pressurized source 51 forces the liquid metal 14 from the pot through the conduits 19, to the apertures 18 and chambers 20, thus eliminating the need for hot metal pump 42. Molten metal leaves the fluid-tight compartment 45 through drain return aperture 53 and flows through a return conduit 55 to the pot 48 or to a separate pot 48'. Likewise, overflow metal from troughs 50 is carried by conduits 59 or 59' to pots 48 or 48', respectively. Use of a second pot 48, for overflow molten metal 14 greatly reduces the dross problem. Use of pressurized gas sources 51, 51' also serves to control the dross problem. The pot 48 of reduced size, as illustrated in FIG. 6, allows for a shorter heating time and more efficient and effective temperature control of the liquid metal contained therein. Overall energy costs for maintaining the molten metal are reduced compared to the prior open pot systems. The enclosed environment provided by compartment 44 and cover 49 also significantly reduces or completely eliminates dross and its related surface defects commonly encountered in prior art hot metal coating process lines.

In a further aspect of the invention, the guide members 38 and 39 of FIG. 2A can be employed in combination with the prior art sink roll apparatus of FIG. 1. In such a modified prior art coating apparatus and method, the guide members 38 and 39 of the invention create an artificial strip pumping effect !5 similar to that shown in FIG. 1A, but one which is not dependent on strip speed as in the prior art.

As a further embodiment, a pair of enclosed, pressurized vessels, such as pots 48, 48', can be used alternately in tandem such that, in a first cycle, pot 48 supplies pressurized metal, while pot 48' receives the overflow metal from the closure 75. This cycle continues to the point where pot 48 is nearly empty and pot 48' is nearly full, at which time, the cycle reverses and pot 48, supplies pressurized metal while pot 48 functions as the drain recovery vessel.

During start-up of the substantially frictionless hydrostatic support shown in FIG. 6, the "J"-shaped closure 75, comprising component sections 44, 45, 16, 38 and 39, is preheated to first liquify any metal possibly contained therein from a previous run. The system may be preheated by any suitable means such as by induction heating, gas, or the like. It will be appreciated that during operation, further heating of the "J"-shaped closure is unnecessary because the hot strip 12 from furnace 47 supplies sufficient heat to maintain the lower melting point metal in a fluid state.

As shown in FIG. 6, the strip 12 passes from the furnace 47 to the "J"-shaped closure 75 and bends around the enclosed hydrostatic chute 16 as the preheated strip is coated with molten metal 14 contained within the closure 75. The strip 12 is substantially frictionlessly supported by hydrostatic chute 16 and by hydrostatic guides 38 and 39 as a constant pulling tension is applied to the strip by a conventional take-up coiling system (not shown). The hydrostatic guides 38 and 39 also provide a continuous dross-free zone 15 due to the upwardly pumped liquid metal flow exiting therefrom as previously described and also depicted in FIG. 2A. Thus, line speed is not critical in the embodiment of FIG. 6 and can be varied widely to suit plant economics.

The pair of collection chutes 50 curve upwardly from the hydrostatic guides 38 and 39 to collect excess liquid metal 14 removed from the strip 12 by gas-powered wiping devices 40 and also to collect metal overflowing at 15. Excess molten metal collected by chutes 50 is returned to one of the pots 48 or 48, by conduit 59 or 59', respectively, as mentioned above.

FIG. 6 also discloses a frictionless support 10 constructed on a rail mounted, side shifting and liftable platform 54. The platform 54 includes a first lower stand 56 and a second upper stand 58 mounted thereon. The lower stand 56 has spaced-apart rollers 60 and 62 secured to the bottom thereof mounted for travel on tracks 64 and 66 to provide lateral movement for alignment with furnace 47. The upper stand 58 has a vertical adjustment means 68 secured to the bottom thereof which cooperates with receiving means on stand 56 to provide variable vertical height adjustment of the platform 54. The adjustment means 68 may be any known means for elevating a platform such as a screw device, hydraulic device and the like. Structural members 57 support the "J"-shaped closure 75 and associated hardware above the platform 54. In the rail-mounted system of FIG. 6, a second standby coating unit 10 can be quickly rolled into place to service the furnace 47 with the same or with a different molten metal or alloy as the coating material.

Having described presently preferred embodiments, it is to be understood that the invention may be otherwise embodied within the scope of the following claims.

What is claimed is:

1. A strip treating apparatus for supporting a strip conveyed along a feed path and for contacting both face surfaces of the strip with treatment liquid comprising:

(a) at least one hydrostatic chute having a surface along which the strip is drawn thereby establishing said feed path, said surface having a plurality of chambers confined therein, said chambers enclosed by ridges raised outwardly from said surface over the longitudinal length and transverse width thereof and said chambers having apertures therein for supply of a pressurized treatment liquid into each chamber;

(b) a container for holding a bath of said treatment liquid arranged so that said at least one hydrostatic chute is submerged below the surface of the bath; and (c) means for supplying said pressurized treatment liquid to said apertures and said chambers such that said treatment liquid is flowably restrained within said chambers to maintain said strip spaced from said at least one hydrostatic chute by a hydrostatic force of said pressurized liquid acting upon the strip face surface as the strip is conveyed across said at least one hydrostatic chute.

2. The strip treating apparatus as set forth in claim 1, wherein said at least one hydrostatic chute is curved and said treatment liquid is molten metal.

3. The strip treating apparatus of claim 2 wherein the treatment liquid is one selected from the group consisting of zinc and aluminum.

4. The strip treating apparatus as set forth in claim 2 further comprising a pair of hydrostatic guides positioned adjacent the upper surface of the molten metal bath, said hydrostatic guides adapted to be placed on opposed sides of the strip to direct a flow of molten metal to said upper surface of said molten metal bath to generate and maintain a dross-free zone around said strip as the strip exits molten metal bath.

5. The strip treating apparatus as set forth in claim 4 wherein said means for supplying pressurized molten metal to said at least one hydrostatic chute and guides is a device selected from the group consisting of a liquid metal pump and a pressure vessel.

6. The strip treating apparatus as set forth in claim 2 further comprising a pot for containment of said molten metal in a location spaced from said at least one hydrostatic chute.

7. The strip treating apparatus as set forth in claim 6 wherein said at least one hydrostatic chute is enclosed in a container or a shape to closely contain the strip material.

8. The strip treating apparatus as set forth in claim 7 wherein said enclosed container is mounted for travel on a wheel platform.

9. The strip treating apparatus of claim 1 wherein the treatment liquid is a chemical solution for chemically treating the strip.

10. The strip treating apparatus of claim 9 wherein the strip is steel and the chemical solution is a pickling solution.

* * * * *

UNITED STATES PATENT AND TRADEMARK OFFICE

CERTIFICATE OF CORRECTION

PATENT NO. : 5,069,158

DATED : December 3, 1991

INVENTOR(S) : Giorgio A. Rey

It is certified that error appears in the above-identified patent and that said Letters Patent is hereby corrected as shown below:

On the title page:

under References Cited U.S. PATENT DOCUMENTS
"3,479,097 11/1969 McLaughlan et al. 384/12" should read
--3,479,097 11/1969 McLauchlan et al. 384/12--.

Abstract Line 11 "of" should read --for--.

Column 2 Line 20 "an" should read --and--.

Column 5 Line 24 "2" should read --20--.

Column 8 Line 17 "48" should read --48'--.

Column 8 Line 44 "48" should read --48'--.

Column 9 Line 10 "48, by" should read --48' by--.

Claim 7 Line 38 Column 10 "or" should read --of--.

Claim 8 Line 42 Column 10 "wheel" should read --wheeled--.

Signed and Sealed this

Sixth Day of April, 1993

*Attest:*

STEPHEN G. KUNIN

*Attesting Officer*

*Acting Commissioner of Patents and Trademarks*